US010667637B2

(12) United States Patent
Goodson et al.

(10) Patent No.: US 10,667,637 B2
(45) **Date of Patent: *Jun. 2, 2020**

(54) BEVERAGE COOLER AND HEATER

(71) Applicants: Mark Goodson, Corinth, TX (US); Christian Ross Goodson, Corinth, TX (US)

(72) Inventors: Mark Goodson, Corinth, TX (US); Christian Ross Goodson, Corinth, TX (US)

( * ) Notice: Subject to any disclaimer, the term of this patent is extended or adjusted under 35 U.S.C. 154(b) by 720 days.

This patent is subject to a terminal disclaimer.

(21) Appl. No.: 15/218,442

(22) Filed: Jul. 25, 2016

(65) Prior Publication Data

US 2017/0027359 A1 Feb. 2, 2017

Related U.S. Application Data

(60) Provisional application No. 62/282,165, filed on Jul. 28, 2015.

(51) Int. Cl.

| | |
|---|---|
| ***A47G 23/03*** | (2006.01) |
| ***F25B 21/04*** | (2006.01) |
| ***F25D 31/00*** | (2006.01) |

(52) U.S. Cl.

CPC ..... *A47G 23/0313* (2013.01); *F25B 21/04* (2013.01); *F25D 31/005* (2013.01); *F25D 31/006* (2013.01)

(58) Field of Classification Search

CPC ..... F25D 2303/0841

See application file for complete search history.

(56) References Cited

U.S. PATENT DOCUMENTS

| | | | | |
|---|---|---|---|---|
| 5,718,124 | A * | 2/1998 | Senecal | A47F 3/0443 62/3.6 |
| 6,012,383 | A * | 1/2000 | Lande' | A23G 9/12 366/146 |
| 6,279,470 | B2 * | 8/2001 | Simeray | A47J 39/006 165/48.1 |
| 8,235,389 | B1 * | 8/2012 | Herro | A63B 63/08 273/342 |
| 8,759,721 | B1 * | 6/2014 | Alexander | A47G 19/2288 165/58 |
| 9,035,222 | B2 | 5/2015 | Alexander | |
| 2010/0146991 | A1 * | 6/2010 | Ilercil | F25B 21/02 62/3.3 |
| 2011/0220634 | A1 * | 9/2011 | Yeh | A43B 3/0005 219/482 |
| 2013/0255283 | A1 * | 10/2013 | Berchowitz | F25D 11/00 62/63 |

(Continued)

*Primary Examiner* — Ibrahime A Abraham
*Assistant Examiner* — Elizabeth M Sims
(74) *Attorney, Agent, or Firm* — Gunn, Lee & Cave, PC

(57) ABSTRACT

A system having a beverage coaster with a receiving coil that can be magnetically coupled or decoupled from a driving coil in a counter, table, bar, and the like. The coaster may be magnetically coupled to the table by moving the coaster into an area where the driving coil generates a magnetic field of sufficient strength. The coaster also includes a switch that activated or deactivated based on its proximity to a magnet in the table. The coaster has a metallic plate on which may be positioned a beverage container. The plate is thermally and mechanically coupled to a Peltier cell that either cools or heats the plate, depending on the state of the switch.

5 Claims, 5 Drawing Sheets

(56) References Cited

U.S. PATENT DOCUMENTS

| | | | | |
|---|---|---|---|---|
| 2014/0054010 | A1* | 2/2014 | Peters | F25D 31/002 165/104.11 |
| 2014/0251982 | A1* | 9/2014 | Emma | H05B 6/68 219/679 |
| 2014/0305927 | A1* | 10/2014 | Alexander | A47G 19/027 219/387 |
| 2015/0024349 | A1* | 1/2015 | Bischoff | A47G 23/16 434/127 |

* cited by examiner

BEVERAGE COOLER AND HEATER

CROSS REFERENCE TO RELATED APPLICATIONS

This application claims the benefit of and priority to U.S. provisional application Ser. No. 62/282,165, filed Jul. 28, 2015 and entitled "Serving Table With Inset Beverage Cooling." This provisional application is incorporated by reference.

STATEMENT REGARDING FEDERALLY SPONSORED RESEARCH OR DEVELOPMENT

Not Applicable

BACKGROUND OF THE INVENTION

1. Field of the Invention

The present invention generally applies to temperature control of a liquid. More specifically, the present invention relates to temperature heating and cooling of an already served beverage.

2. Description of the Related Art

Drinks that are served in a restaurant are usually cooled or heated, with many beverages being cooled by ice. Some drinks, such as coffee and cocoa, are enjoyed while being served hot or warm. The laws of heat transfer mandate that over time thermal gain or loss of the beverage will continue until the beverage reaches room temperature (thermal equilibria). Drinks that are cold will usually have ice melt due to heat gain, while drinks served warm or hot will have a heat loss and thus they cool off.

Some issued patents make use of heating and cooling of a glass, cup or similar vessel. Senecal (U.S. Pat. No. 5,718,124), for example, teaches the refrigeration of a service bowl, with the refrigeration circuitry being part of the bowl. Similarly, Alexander (U.S. Pat. Nos. 8,759,721 and 9,035,222) teach the use of heated or cooled beverage holders where the circuitry that is providing the temperature change is part of the glassware or serving dishes. Simcray (U.S. Pat. No. 6,279,470) teaches the use of vessel that has an armature as part of the plate or food holder. Simcray, however, does not teach the use of a coaster that can accommodate various cooking vessels that may already be owned by the user.

BRIEF SUMMARY OF THE INVENTION

The present invention provides a number of advantages over existing art. For example, the present invention allows the cooling of a beverage holder (e.g., a cup or glass) without the necessity of that beverage holder containing any circuitry or specially designed components. Moreover, the present invention allows heating or cooling of the beverage holder to be selected without the use of any manually operated switch; instead, a change of alignment of the coaster will allow the cooling or heating mode to turned off or put the coaster into the desired mode.

Structurally, the present invention comprises a beverage coaster having a first end, an opposing second end, a housing, a non-corrosive metallic plate connected to the housing at the first end, a Peltier cell within the housing mechanically and thermally connected to the metallic plate, a switch within the housing, a receiving coil located within the housing proximal to the second end, and coaster circuitry electrically connected to the Peltier cell, the switch, and the receiving coil; and a counter or table with a top surface and a bottom surface, a magnet, a driving coil, and driver circuitry connected to the driving coil.

DESCRIPTION OF SPECIFIC EMBODIMENTS

Figure 1:
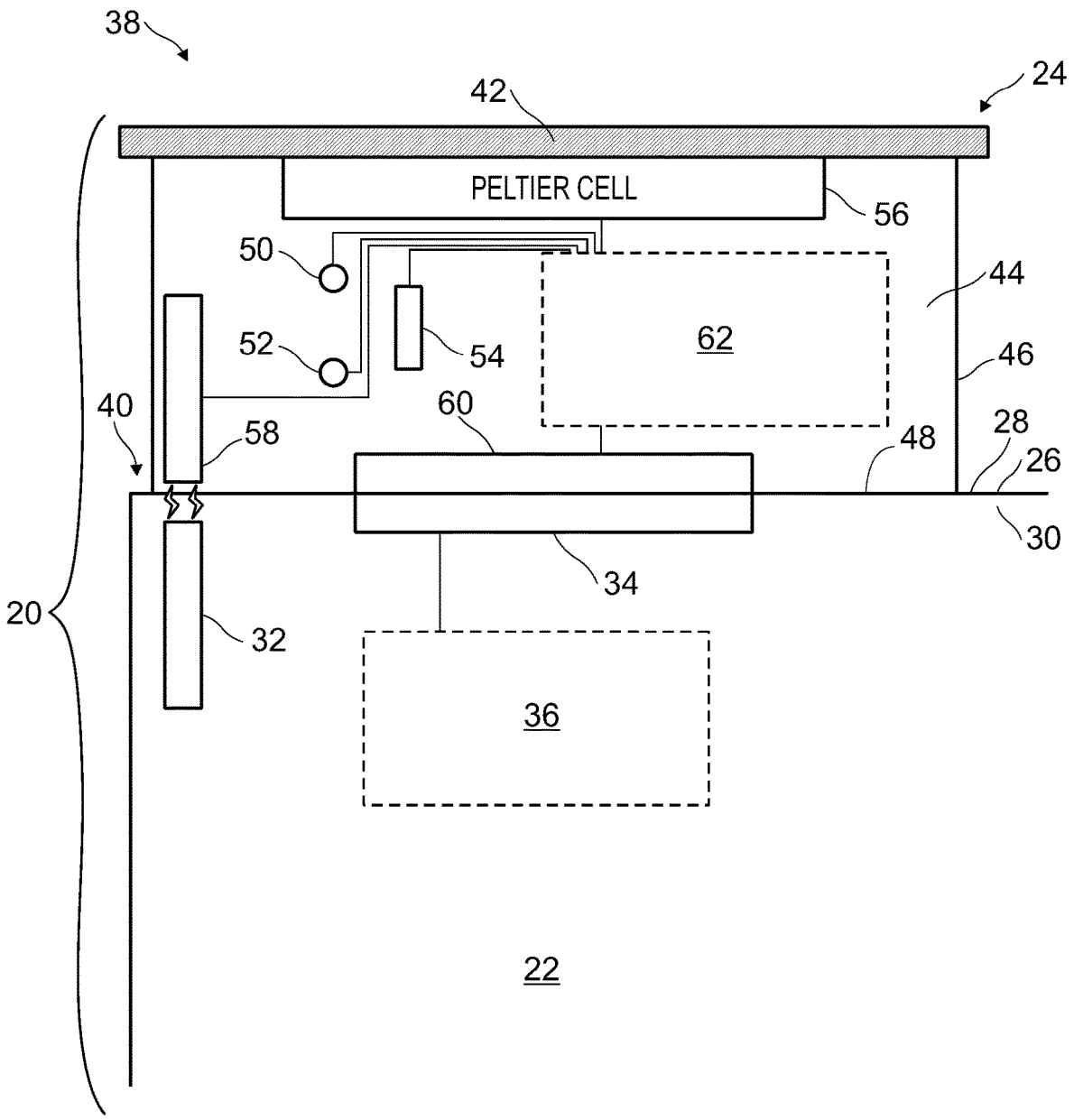
FIG. 1 shows an embodiment of the present invention.

FIG. 1 shows an embodiment 20 of the invention, which includes a counter 22 and a beverage coaster 24. The counter 22 includes a countertop 26 with a top surface 28 and a bottom surface 30, a rod magnet 32, an inductive driving coil 34, and driver circuity 36 electrically connected to the coil 34. The rod magnet 32, inductive driving coil 34, and driver circuitry 36 are adjacent to the bottom surface 30 of the countertop 26. While this embodiment 20 contemplates the driving coil 34 and driver circuitry 36 being adjacent the countertop, alternatively, they can be inset as part of the countertop 26. Although this embodiment 20 is described specifically with reference to a countertop, other embodiments contemplate the invention include a table, bar top, and the like.

The coaster 24 is generally a closed cylinder with a first end 38 and a second end 40. The second end 40 contacts the countertop 26 opposite the driver circuitry 36. The coaster 24 is made of a solid cylindrical copper plate 42 attached to a hollow cylindrical plastic housing 44 with a sidewall 46 and a closed end 48 coterminal with the second end 40. A red LED 50, a blue LED 52, and a USB port 54 are mounted to the sidewall 46. Copper is preferred because of its resistance to corrosion and for its coefficient of thermal conductivity, but other metals may be used.

The housing 44 encloses a Peltier cell 56 (sometimes called a Peltier device, Peltier heat pump, solid state refrigerator, or thermoelectric cooler (TEC)), a reed switch 58, a receiving coil 60, and coaster circuitry 62. The Peltier cell 56 is mechanically and thermally connected to the copper plate 42. The thermal connection is enhanced with the use of thermally conducting grease (not shown) between the Peltier cell 56 and the copper plate 42. The reed switch 58 is adjacent to the sidewall 46 of the housing 44 and is aligned with, and magnetically coupled to, the magnet 32. The receiving coil 60 is located proximal to the closed end 48 and is vertically aligned with the driving coil 34. The coaster circuity 62 electrically connects the LEDs 50, 52, the USB port 54, the Peltier cell 56, and the reed switch 58.

Figure 2:
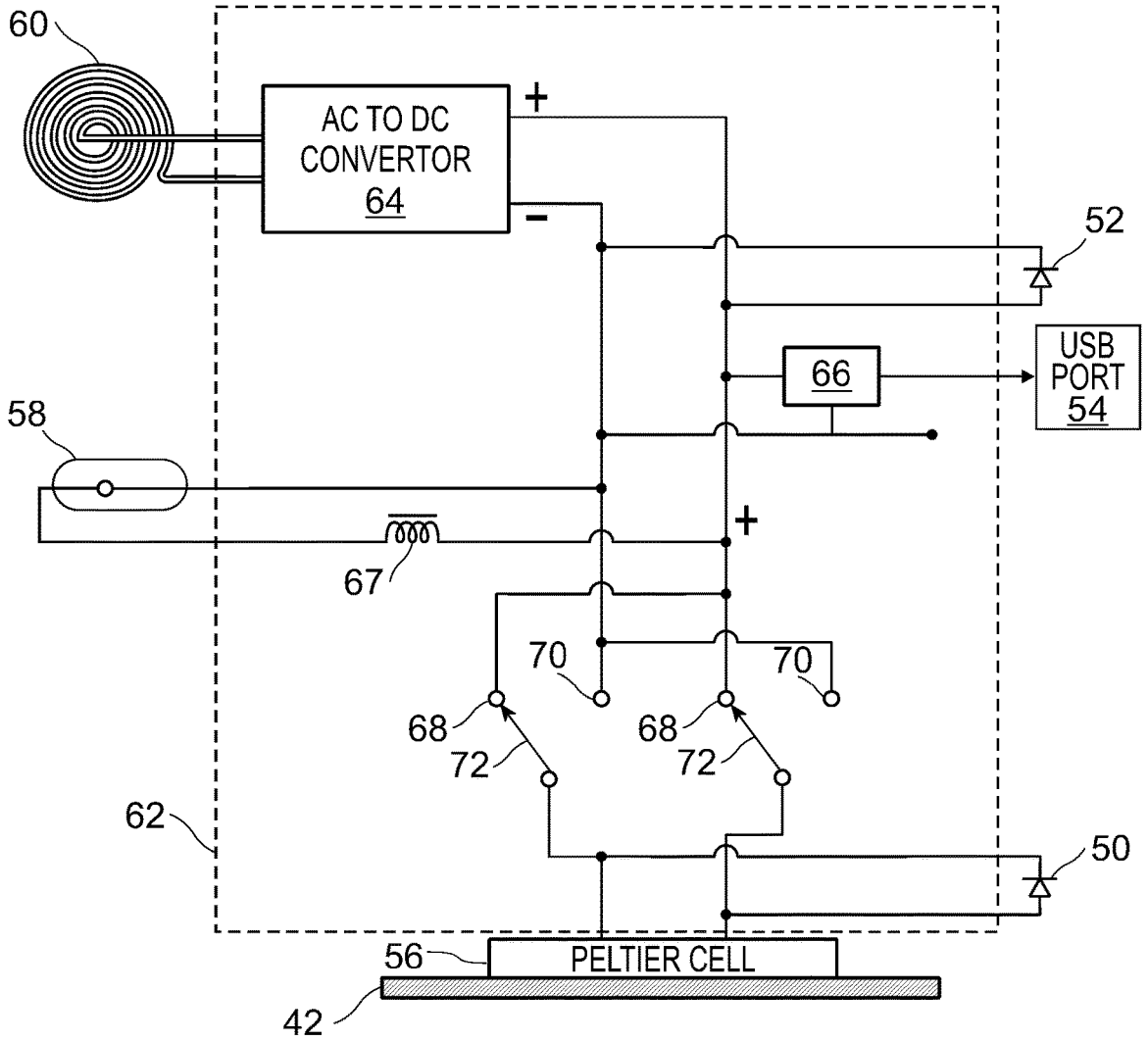
FIG. 2 is a schematic of the coaster circuitry of the embodiment in a "heating" configuration.

Referring to FIG. 2, the coaster circuity 62 includes an AC-to-DC converter 64 connected to the receiving coil 60, a voltage regulator 66 connected to the USB port 54, a relay coil 67 connected to the reed switch 58, a first pair of relay contacts 68, a second set of relay contacts 70, and a pair of relay armatures 72. The regulator 66 is a standard 3-lead 5-volt regulator that provides power to the USB port 54, allowing the coaster 24 to also serve as a means for charging a phone or operating a game.

In FIG. 2, the reed switch 58 and armatures 72 are in the state corresponding to the position of the coaster 24 shown in FIG. 1, with the reed switch 58 aligned with the magnet 32. The reed switch 58 is closed and the armatures 72 are in contact with the first pair of contacts 68. This configuration causes the Peltier cell 56 to generate heat at the connection with the copper plate 42. The red LED 50 is in parallel with the input of the Peltier cell 56 and will be energized in this configuration when the receiving coil 60 is energized. The blue LED 53 is energized whenever the receiving coil is energized, regardless of the state of the reed switch 58.

Figure 3:
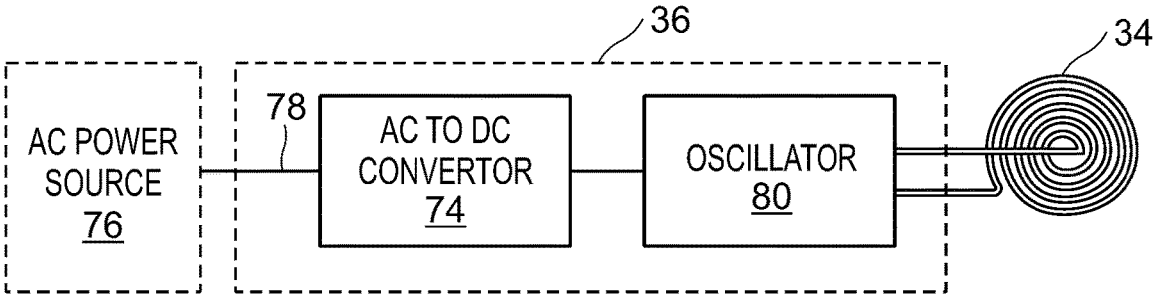
FIG. 3 is a schematic of the driver circuitry of the embodiment.

Referring to FIG. 3, the driver circuitry 36 includes an AC-to-DC converter 74 connectable to an AC input source 76 (nominal 120 VAC 60 Hz) with a line cord 78. The converter 74 rectifies and filters the signal from the input source 76. The output of the converter 74 is connected to a 10 KHz oscillator 80 that generates a square wave. The output of the oscillator 80 is connected to the driving coil 34. The driver circuitry 36 is enclosed so it is protected from mechanical damage (e.g., spills, mechanical cuts from serving utensils).

Figure 4:
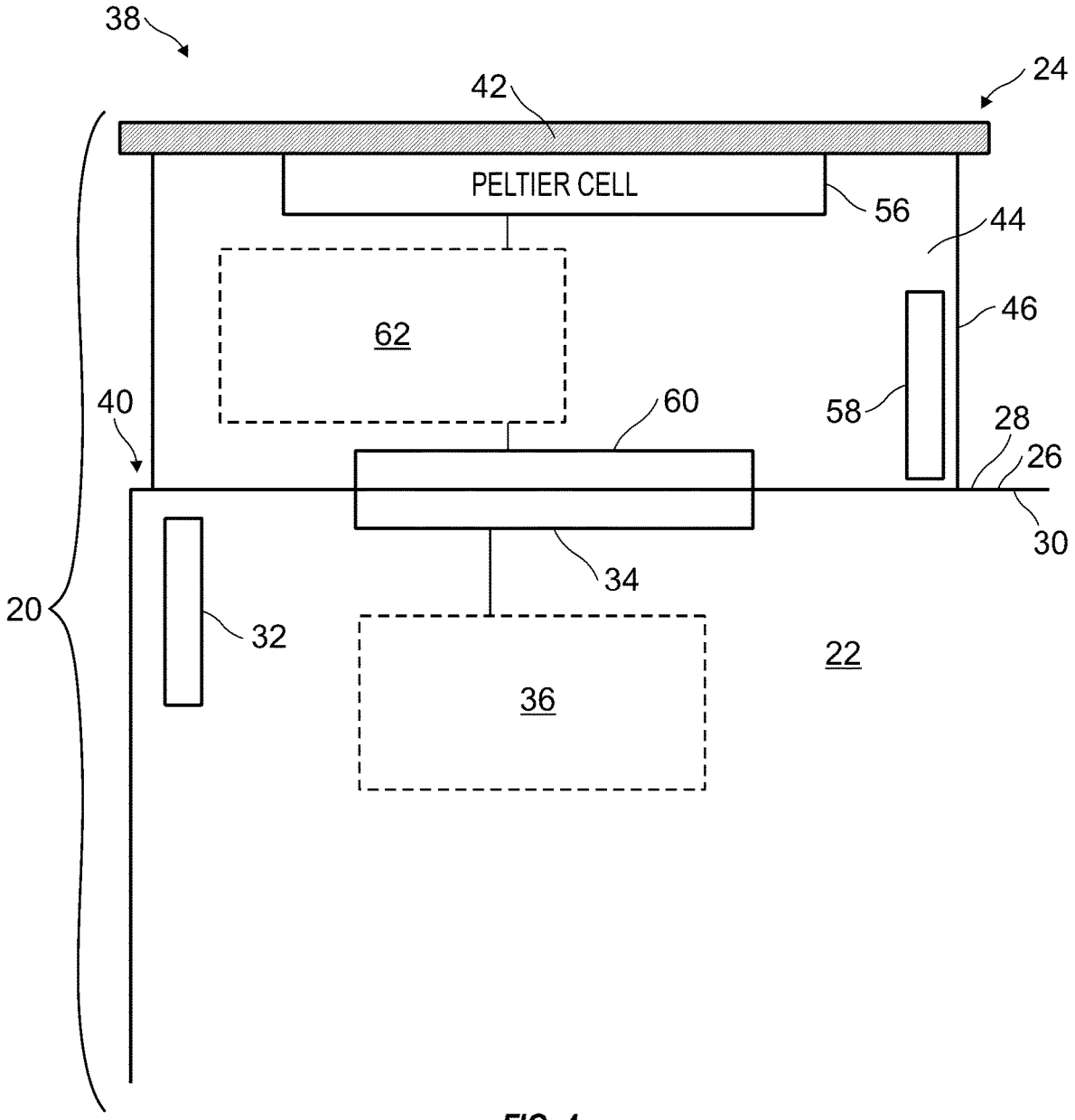
FIG. 4 shows the reed switch of the coaster misaligned with the magnet of the countertop.

Referring to FIG. 4, the coaster 24 is rotated 180 degrees relative to its position in FIG. 1 so the reed switch 58 is not aligned with the rod magnet 32.

Figure 5:
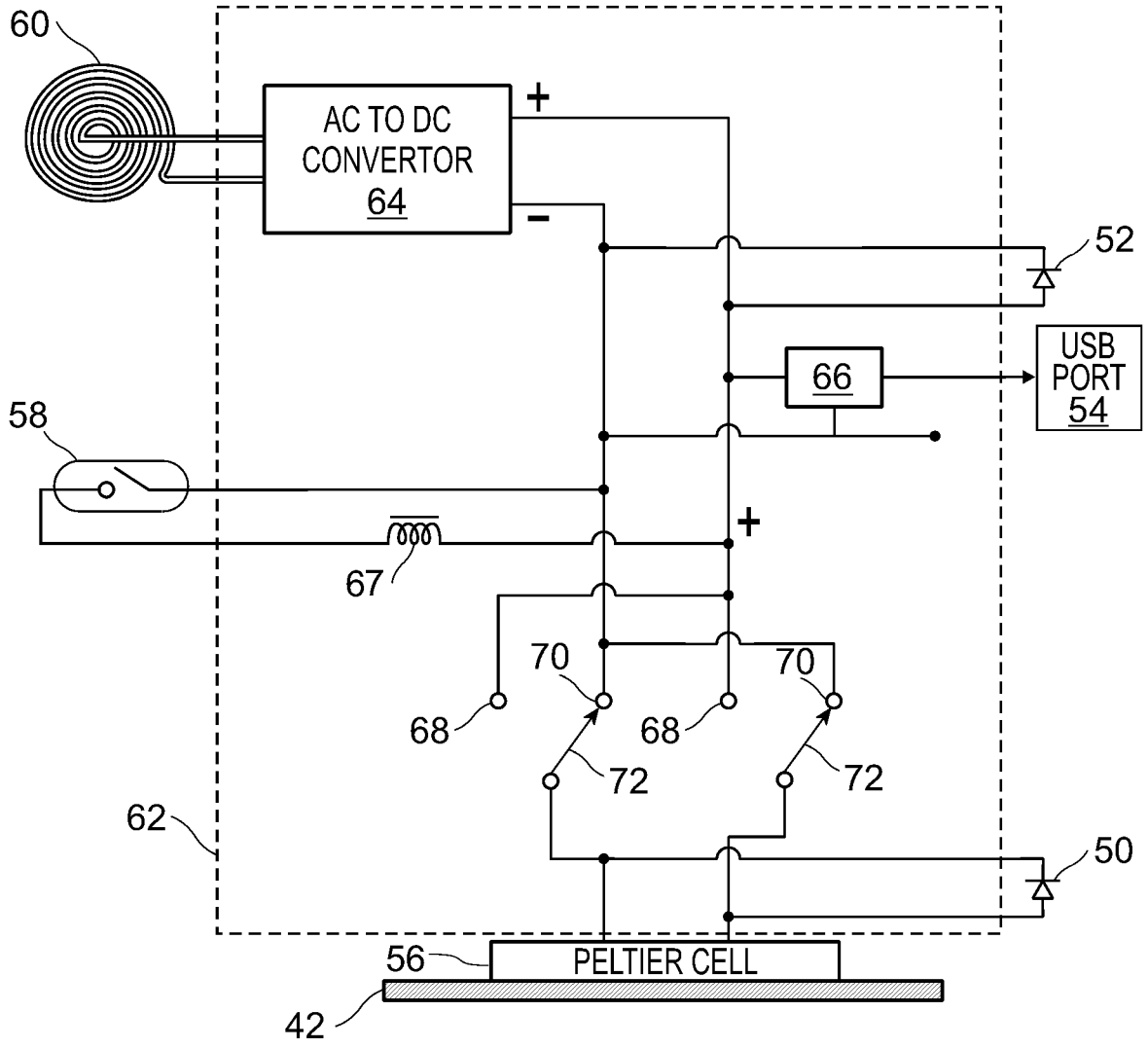
FIG. 5 is a schematic of the coaster circuitry of the embodiment in a "cooling" configuration.

Referring to FIG. 5, when the reed switch 58 is not aligned with the magnet 32, the reed switch 58 is open. This causes the armatures 72 to be in their normal position of contact with the second set of contacts 70. This configuration causes the Peltier cell 56 to cool at its connection with the copper plate 42. Only the blue LED 52 is energized in this configuration, indicating magnetic coupling (and resultant energy transfer) between the driving coil 34 (see FIG. 3) and the receiving coil 60 in the coaster 24.

Figure 6:
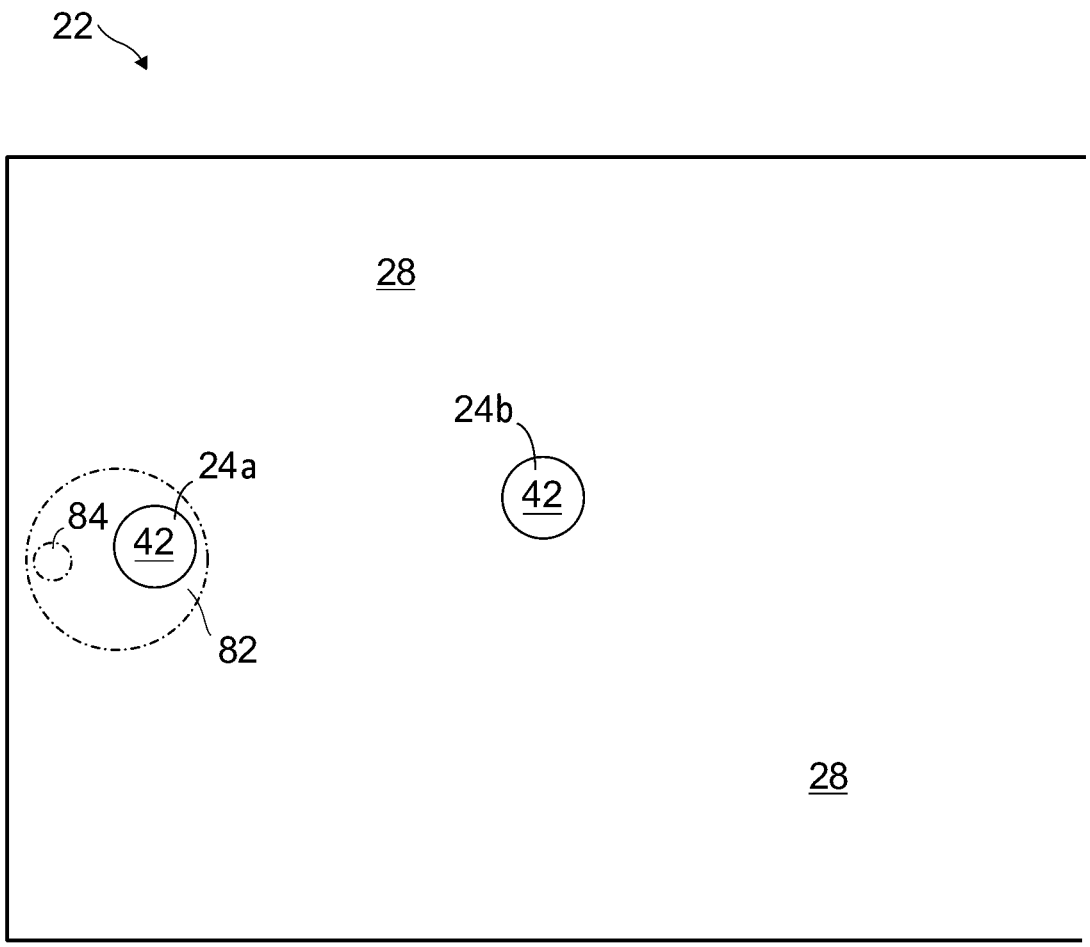
FIG. 6 is a top view of the countertop of the present invention shown two coasters.

Referring to FIG. 6, when powered, the driver circuity 36 (not shown) generates a magnetic field that intersects an area 82 of the top surface 28 in which coasters 24*a*, 24*b* will be energized when in contact with the top surface 28. The reed switch 58 (not shown) of the coasters 24*a*, 24*b*, however, must be within a smaller area 84 above the magnet 32 (not shown) to close the reed switch and cause the Peltier cell to heat the copper plate 42 as described with reference to FIG. 2. In FIG. 6, coaster 24*a* is energized and coaster 24*b* is not energized.

The present invention is described in terms of a specifically described embodiment. Those skilled in the art will recognize that other embodiments of such method and system can be used in carrying out the present invention. Other aspects and advantages of the present invention may be obtained from a study of this disclosure and the drawings, along with the appended claims.

We claim:

1. A beverage heating and cooling system comprising:

a beverage coaster having a first end, an opposing second end, a housing, a metallic plate connected to the housing at the first end, a Peltier cell within the housing mechanically and thermally connected to the metallic plate, a switch within the housing having a first position that results in cooling the metallic plate and a second position that results in heating the metallic plate, a receiving coil located within the housing proximal to the second end, and coaster circuitry electrically connected to the Peltier cell, the switch, and the receiving coil; and a counter with a countertop having a top surface and a bottom surface, a magnet, a driving coil, and driver circuitry connected to the driving coil wherein the driving coil is magnetically coupled with the receiving coil and the position of the beverage coaster in relation to the counter determines whether the switch is in the first position or second position.

2. The system of claim 1 further comprising driver circuitry electrically connected to the driving coil.

3. The system of claim 1 further comprising a USB port mounted to the housing and electrically connected to the coaster circuitry.

4. The system of claim 1 further comprising an AC-to-DC converter connected to the receiving coil.

5. The system of claim 1 wherein the orientation of the magnet in relation to the switch determines if the switch is in the first position or the second position.

* * * * *